US006483055B1

(12) United States Patent
Tanabe et al.

(10) Patent No.: US 6,483,055 B1
(45) Date of Patent: Nov. 19, 2002

(54) SEAT SENSOR AND DETECTION DEVICE USING THE SAME

(75) Inventors: Koji Tanabe, Osaka (JP); Kenichi Takabatake, Osaka (JP); Takao Matsui, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 86 days.

(21) Appl. No.: 09/699,512

(22) Filed: Oct. 31, 2000

(30) Foreign Application Priority Data

Nov. 1, 1999 (JP) ..... 11-310558

(51) Int. Cl.[7] ..... H01H 13/00
(52) U.S. Cl. ..... 200/85 A; 200/512
(58) Field of Search ..... 200/85 A, 86 R, 200/86 A, 512, 514; 338/47, 99, 100, 211

(56) References Cited

U.S. PATENT DOCUMENTS 4,623,766 A 11/1986 Utagawa et al.
5,179,460 A * 1/1993 Hinata et al. ..... 200/512 X
5,986,221 A * 11/1999 Stanley ..... 200/85 A X

* cited by examiner

*Primary Examiner*—Renee Luebke
(74) *Attorney, Agent, or Firm*—Wenderoth, Lind & Ponack, L.L.P.

(57) ABSTRACT

A seat sensor includes a top sheet made of insulating film; an upper insulating layer with insulating particles partially protruding from the surface of the upper insulating layer; and an upper resistor layer formed over the upper insulating layer. The seat sensor further includes a bottom sheet made of insulating resin film disposed under the top sheet; a lower insulating layer with insulating particles partially protruding from the surface of the lower insulating layer; a lower resistor layer formed over the lower insulating layer, and an insulating spacer layer formed between the top sheet and the bottom sheet. The above construction provides a seat sensor that has stable resistance properties even after repeated loading and a detection device using the seat sensor.

18 Claims, 9 Drawing Sheets

SEAT SENSOR AND DETECTION DEVICE USING THE SAME

FIELD OF THE INVENTION

The present invention relates to a seat sensor disposed inside the seat of a vehicle for detecting the existence of a passenger and to a detection device using the seat sensor.

BACKGROUND OF THE INVENTION

Description of the Prior Art

Recently, as vehicles have become equipped with many kinds of high-level functions, various seat sensors have been used to control functions such as actuation of an air bag system or indication of a seatbelt sign by detecting a seated passenger and determining a weight of the passenger.

A conventional seat sensor is described with reference to FIG. 11 through FIG. 15.

FIG. 11 is a cross sectional view of the conventional seat sensor. In FIG. 11, upper resistor layer 2, which is a pressure sensitive resistor element and is made of resins with conductive particles and insulating particles dispersed therein, is formed by printing underneath top sheet 1 made of flexible insulating films like polyethylene terephthalate or polyimide.

Bottom sheet 3 made of a flexible insulating film is disposed under top sheet 1. A pair of comb-like conductive layers 4 are formed over bottom sheet 3. Conductive layer 4 is formed by etching a copper foil bonded to a sheet or by printing flexible resins like polyester or epoxy resin, including silver or carbon dispersed therein, over a sheet. Lower resistor layer 5, which is a pressure sensitive resistor element and is made of resins with conductive particles and insulating particles dispersed therein, is formed by printing over conductive layer 4 so that bottom resistor layer 5 is opposed to upper resistor layer 2 formed underneath top sheet 1.

Insulating spacer 6 is made of insulating film 6A and adhesive 6B and 6C coated on both surfaces of insulating film 6A. Opening 6D is formed in the center of insulating spacer 6. Top sheet 1 is bonded to bottom sheet 3 via insulating spacer 6, and opening 6D keeps a predetermined distance between upper resistor layer 2 and lower bottom resistor layer 5 which oppose each other. The conventional seat sensor is produced in this manner.

As shown in an enlarged cross sectional view in FIG. 12, upper resistor layer 2 and lower resistor layer 5 are made of insulating resins 2A and 5A, including epoxy resin, phenol resin polyester resin or the like. The resistor layers include conductive small-diameter particles 2B and 5B, such as carbon black particles, and insulating particles 2C and 5C, which have large diameters as compared with the thickness of insulating resin layers 2A and 5A, and these particles are dispersed in insulating resins 2A and 5A.

The seat sensor formed as described above is placed inside the seat of a vehicle. When a passenger sits, top sheet 1 deflects due to the weight of the passenger and top resistor layer 2 makes contact with bottom resistor layer 5 as shown in a cross sectional view in FIG. 13. In a first stage of contact between upper resistor layer 2 and lower resistor layer 5, insulating particles 2C and 5C (which partially protrude from the surfaces of insulating resin 2A and 5A) are in contact with insulating layer 5A and 2A, respectively, as shown in an enlarged cross sectional view in FIG. 14A.

Then, as further load is applied to the seat sensor by a passenger, insulating resin 5A including conductive particles 5B dispersed therein makes contact with insulating resin 2A including conductive particles 2B dispersed therein. A contact area between insulating resins 2A and 5A increases as the load increases. Therefore, resistance between the two conductive layers 4 decreases. When a passenger is seated completely and the load applied to the seat sensor reaches a constant value, the contact area between upper resistor layer 2 and lower resistor layer 5 becomes a constant value. Therefore, resistance between the two conductive layers reaches a constant low value not more than a predetermined value as compared with the resistance in a first stage of contact.

Resistance of the seat sensor is a summed value of the resistance at each point where upper resistor layer 2 makes contact with lower resistor layer 5. A vehicle electronic circuit coupled to conductive layer 4 detects resistance of the seat sensor and determines whether the seat has a passenger, and whether the weight of the seated passenger is not less than a predetermined value. The electronic circuit is constructed so that it can indicate to a seatbelt usage sign or a control air-bag system whether the weight of the seated passenger is not less than a predetermined value.

However, in the conventional seat sensor described above, when a load is repeatedly applied to the seat sensor, particles 2C and 5C peel away with insulating resins 2A and 5A at an interface, and a gap 7 is formed between them. Because not only insulating particles 2C and 5C but also conductive particles 2B and 5B are dispersed in upper resistor layers 2 and 5, respectively, the holding strength of insulating resins 2A and 5A for insulating particles 2C and 5C is low.

Moreover, insulating particles 5C bite into conductive layer 4 by repeated loading and the amount of insulating particles 5C protruding from the surface of insulating resin 5A decreases because low resistor layer S is formed over conductive layer 4. As a result, a contact area between upper resistor layer 2 and lower resistor layer 5 changes and becomes different from the contact area at the beginning of use, and resistance reduces inversely with the applied load. In other words, a problem occurs in that resistance properties become unstable.

The present invention addresses the problem, and it provides a seat sensor having stable resistance properties and a detection device using the seat sensor.

SUMMARY OF THE INVENTION

A seat sensor of the present invention comprises a top sheet made of an insulating film, and an upper insulating layer which has insulating particles partially protruding from a surface of the upper insulating layer and which is formed underneath the top sheet. The seat sensor further comprises an upper resistor layer formed on the upper insulting layer, a bottom sheet made of insulating film disposed under the top sheet, a lower insulating layer which has insulating particles partially protruding from a surface of the lower insulating layer and which is formed on the bottom sheet, a lower resistor layer formed on the lower insulating layer, and an insulating spacer layer formed between the top seat and the bottom sheet.

The seat sensor of the present invention has a conductive layer between the insulating layer and the resistor layer, if necessary. The seat sensor also has an insulating spacer layer having ends that smoothly slope.

DESCRIPTION OF THE PREFERRED EMBODIMENTS

Exemplary embodiments of the invention are described hereinafter with reference to FIG. 1 through FIG. 10. The parts corresponding to the layers shown in the description of the prior art are identified with the same numeral and a detailed description is omitted.

First Embodiment

Figure 1:
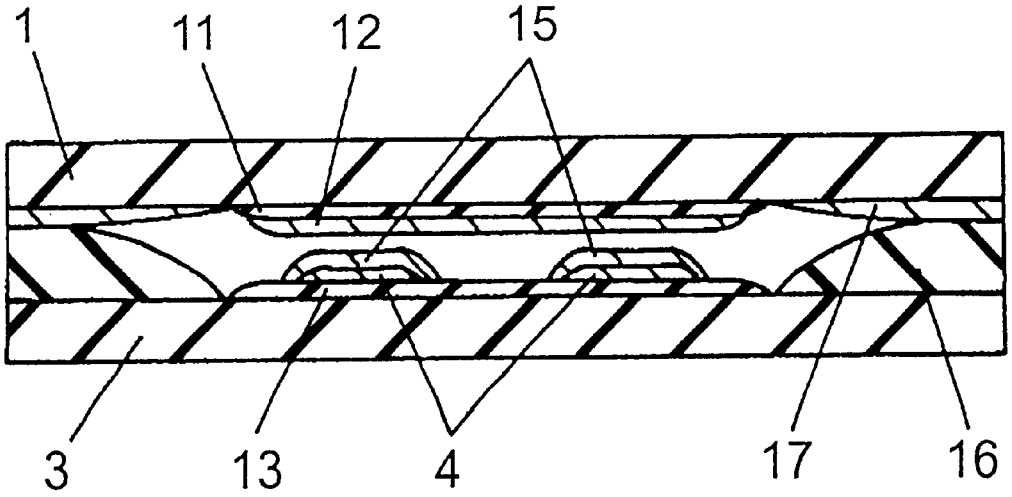
FIG. 1 is a cross sectional view of a seat sensor in accordance with a first exemplary embodiment of the present invention.

FIG. 1 is a cross sectional view of a seat sensor in accordance with a first exemplary embodiment of the present invention. In FIG. 1, upper insulating layer 11 made of resins with insulating particles dispersed therein is formed by printing underneath top sheet 1 made of flexible insulating films such as polyethylene terephthalate(PET) or polyimide(PI). Upper resistor layer 12, which is a pressure sensitive resistor element and is made of resins with carbon-based conductive particles dispersed therein, is formed by printing over upper insulating layer 11.

Lower insulating layer 13 made of resins with insulating particles therein is formed by printing over bottom sheet 3 made of flexible resins such as PET or PI. Bottom sheet 3 is disposed under top sheet 1. A pair of comb-like conductive layers 4 made of resins with silver-based conductive particles dispersed therein and lower resistor layer 15 including carbon-based conductive particles dispersed therein are formed by printing over lower insulating layer 13. Lower resistor layer 15, which is a pressure sensitive resistor element, is opposed to upper resistor layer 12.

Insulating spacer layer 16 made of flexible resins such as epoxy, phenolic or polyester resin is formed by printing, and insulating spacer layer 16 has smoothly-sloping ends and surrounds each layer formed over bottom sheet 3 as described above. A cross section of a sloping end of insulating spacer layer 16 may be a straight line, an upward arcuate line, a downward arcuate line or an arbitrary curve. Adhesive layer 17 made of resins such as polyester resin or acrylic resin is formed by printing around each layer underneath top sheet 1. Adhesive layer 17 bonds top sheet 1 to bottom sheet 3. Insulating spacer 16 maintains a predetermined distance between upper resistor layer 12 and lower resistor layer 15 which oppose each other. The seat sensor of the present embodiment is thus constructed.

Figure 2:
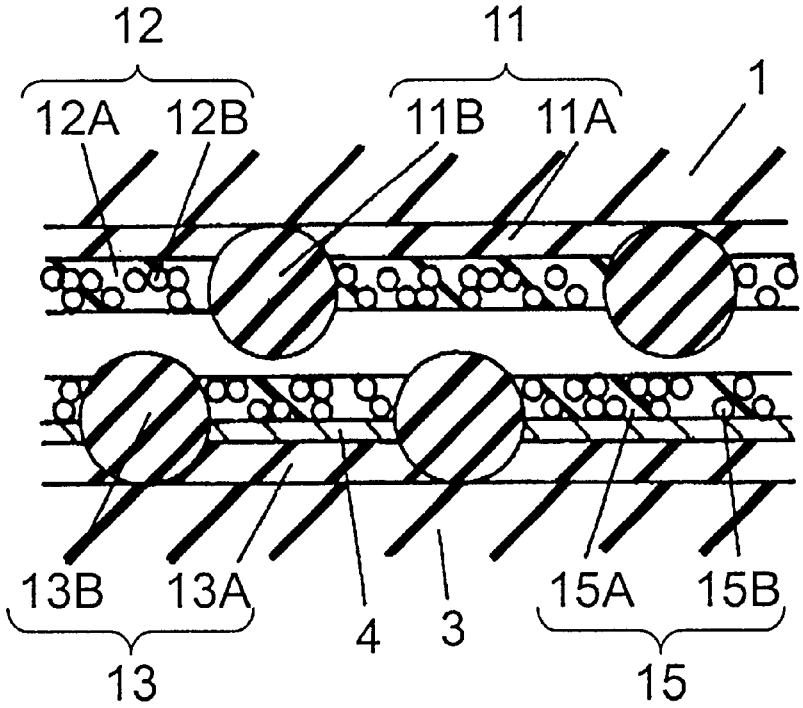
FIG. 2 is an enlarged cross sectional view of the seat sensor in accordance with the first exemplary embodiment of the present invention.
Figure 3:
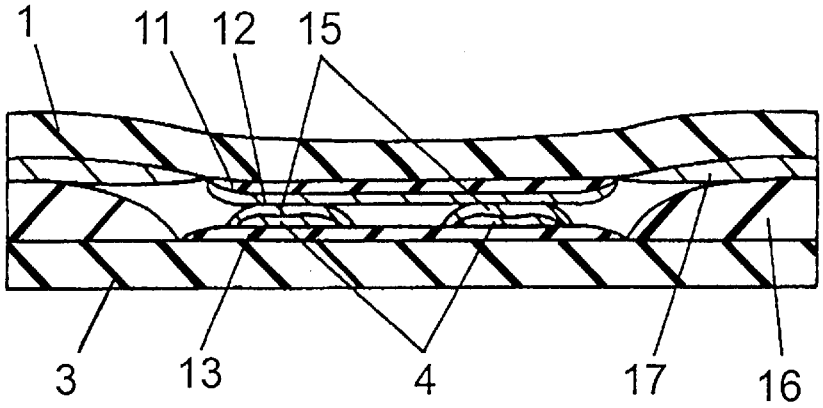
FIG. 3 is a cross sectional view of the seat sensor in an operating condition in accordance with the first exemplary embodiment of the present invention.

As shown in an enlarged cross sectional view in FIG. 2, upper insulating layer 11 and lower insulating layer 13 are made of insulating resins 11A and 13A such as epoxy resin or urethane resin, and include insulating particles having an average diameter of 5 to 20 $\mu$m and which are made of inorganic powder such as glass beads, or insulating particles 11B or 13B made of phenolic resin, silicon resin or acrylic resin dispersed in upper and lower insulating layers 11 and 13. Furthermore, insulating particles 11B and 13B partially protrude from the surface of insulating layer 11A and 13A, respectively.

Upper resistor layer 12 and lower resistor layer 15 are made of insulating resins 12A and 15A such as epoxy resin, phenolic resin or polyester resin, with carbon-based conductive particles 12B and 15B such as carbon black dispersed therein.

Conductive layers 4 are made of flexible resins such as polyester resin or epoxy resin including silver particle or carbon particle or the like dispersed therein, like the related art. Metal foil produced by other methods such as electroless plating or sputtering may be used for conductive layers 4.

The seat sensor produced above is placed inside the vehicle seat. When a passenger sits, top sheet 1 deflects due to the weight of the passenger as shown in a cross sectional view in FIG. 3. Then, upper resistor layer 12 makes contact with lower resistor layer 15. FIG. 2 shows a contact state between upper resistor layer 12 and lower resistor layer 15. Insulating particles 11B and 13B are in contact with the surfaces of insulating resins 15A and 12A, respectively. Insulating particles 11B and 13B are opposite to insulating resin 15A and 12A, respectively. Furthermore, insulating particles 11B and 13B are held with high adhesive strength by insulating resins 11A and 13A, which include no other particles.

As a load applied on the seat sensor by a passenger increases, upper resistor layer 12 makes contact with lower resistor layer 15. Then, a contact area between two layers increases according to the increase of the load, and a resistance between the upper resistor layer 12 and the lower resistor layer 15 decreases. When the passenger is seated completely, the contact area reaches a constant value and the resistance reduces as compared with that at a begins step of seating, and the resistance becomes a constant value not more than a predetermined value.

A resistance in the seat sensor is derived from the resistance of each contact point between upper layer 12 and lower resistor layer 15. A vehicle electronic circuit coupled to conductive layer 4 detects the resistance derived from the resistance of each contact point in the seat sensor and determines whether the seat has a passenger, or whether the seated passenger does not weigh less than a predetermined value. In the present embodiment, the seat sensor is constructed so that top sheet 1 deflects along smooth ends of insulating spacer layer 16 formed by printing over bottom sheet 3.

According to the present embodiment, insulating particles 11B and 13B are securely held by insulating resins 11A and 13A which include no other particles. Upper insulating layer 11 and lower insulating layer 13 are directly formed over top sheet 1 and bottom sheet 3, respectively. Therefore, even when top sheet 1 and bottom sheet 3 are loaded repeatedly, insulating particles 11B, 13B and insulating resins 11A, 13A hardly peel off at their interfaces, and also insulating particles 11B and 13B hardly bite into other layers. Thus, a seat sensor having stable resistance properties is produced according to the present embodiment.

Conductive layer 4 is formed between lower insulating layer 13 and lower resistor layer 15, and lower insulating layer 12 is directly formed over bottom sheet 3. Insulating particles 13B does not bite into conductive layer 4, and upper resistor layer 12 makes a secure contact with lower resistor layer 15 with high repeatability as compared with the prior art in which conductive layer 4 is formed between bottom sheet 3 and insulating layer 13. As a result, the seat sensor of the present invention can provide stable resistance properties. Insulating spacer layer 16 formed integrally over bottom sheet 3 maintains a predetermined distance between upper resistor layer 12 and lower resistor layer 15 which oppose each other. Therefore, an inexpensive seat sensor, which has a small number of components and can be assembled easily, is provided. Moreover, in the present embodiment, as insulating spacer layer 16 has smoothly-sloping ends, when top sheet 1 is deflected and upper resistor layer 12 makes contact with lower resistor layer 15, top sheet 1 and upper resistor layer 12 are bent smoothly along the surface of insulating spacer layer 16. Therefore, failure of top sheet 1 or upper resistor layer 12 and the dispersion of the resistance can be prevented.

In the description above, upper insulating layer 11 and upper resistor layer 12 are formed by printing underneath top sheet 1 so that they overlap. A pair of comb-like conductive layers 4 and lower resistor layer 15 are formed by printing over lower insulating layer 13 formed over bottom sheet 3, and the two lower resistor layers 15 are coupled to each other via upper resistor layer 12.

Figure 4:
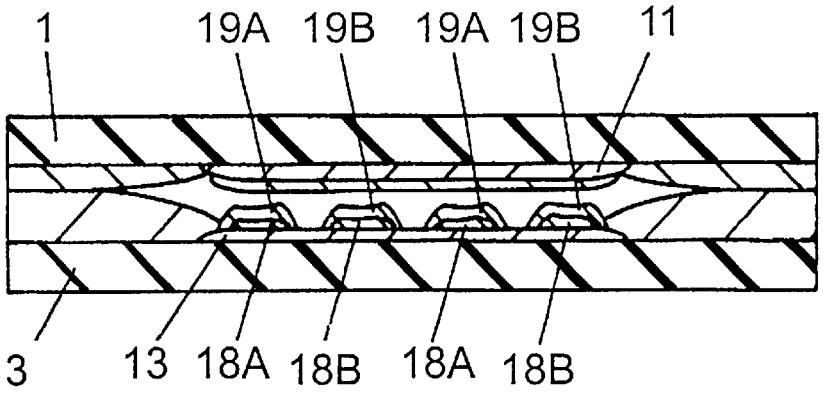
FIG. 4 is a cross sectional view of a seat sensor having a plurality of lower resistor layers in accordance with the first exemplary embodiment of the present invention.

As shown in a cross sectional view in FIG. 4, another laminated structure also can be used for the seat sensor. A plurality of lower resistor layers 19A and 19B may be formed by printing on a plurality of comb-like conductive layers 18A and 18*b*, respectively, so that they overlap.

Figure 5:
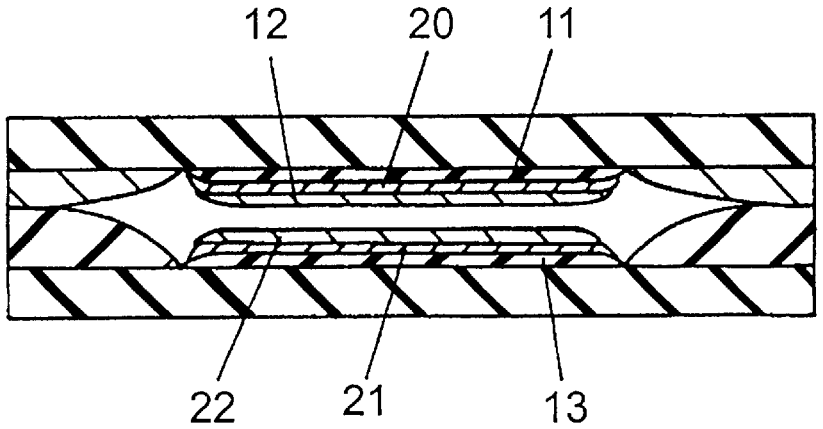
FIG. 5 is a cross sectional view of a seat sensor having upper resistor layer and lower resistor layer in accordance with the first exemplary embodiment of the present invention.

Moreover, conductive layer 20 is formed between upper insulating layer 11 and upper resistor layer 12, and conductive layer 21 and lower resistor layer 22 are formed by printing over lower insulating layer 13 as shown in a cross sectional view in FIG. 5. With this construction, upper resistor layer 12 and lower resistor layer 22 contact each other, and a resistance is detected from conductive layers 20 and 21.

Second Embodiment

Figure 6:
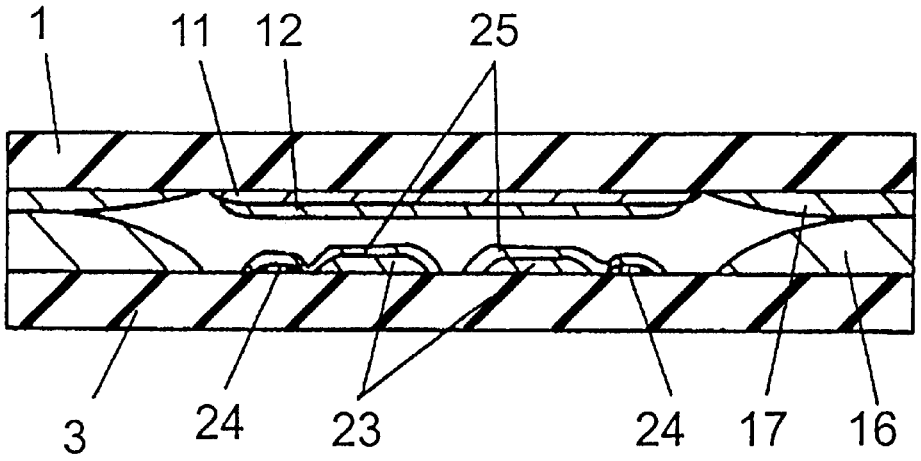
FIG. 6 is a cross sectional view of a seat sensor in accordance with a second exemplary embodiment of the present invention.
Figure 7:
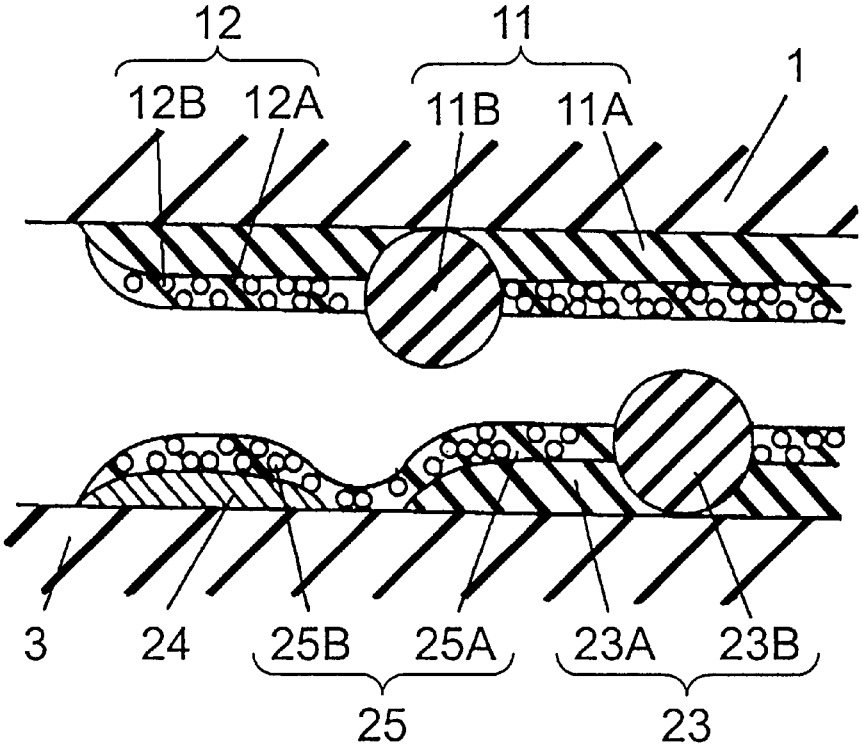
FIG. 7 is an enlarged cross sectional view of the seat sensor in accordance with the second exemplary embodiment of the present invention.

FIG. 6 is a cross sectional view of the seat sensor in a second embodiment of the invention. FIG. 7 is an enlarged cross sectional view of FIG. 6. In FIG. 7, upper insulating layer 11 made of insulating resin 11A with insulating particles 11B dispersed therein is formed by printing underneath top sheet 1. Upper resistor layer 12, which is a pressure sensitive resistor element and is made of insulating resin 12A with conductive particles dispersed therein, is formed by printing over insulating layer 11. This laminated structure as described above is the same as the structure in the first embodiment.

On the other hand, lower insulating layer 23 made of insulating resin 23A with insulating particles 23B dispersed therein is formed by printing over bottom sheet 3 as in the first embodiment. However, conductive layer 24 is formed by printing and keeps a predetermined distance apart from lower insulating layer 23 over bottom sheet 3. Moreover, lower resistor layer 25, which is a pressure sensitive resistor element and is made of insulating resin 25A with conductive particles 25B dispersed therein, is formed by printing over conductive layer 24 and lower insulating layer 23. A seat sensor is thus constructed.

The seat sensor produced as described above is disposed inside the seat of a vehicle. When a passenger sits, bottom sheet 1 is deflected by the weight of the passenger and upper resistor layer 12 over top sheet 1 makes contact with lower resistor layer 25 over bottom sheet 3 as in the first embodiment. As shown in FIG. 7, lower resistor layer 25 also is directly formed over lower insulating layer 23. Thus, when a thickness of upper insulating resin layer 11A is equal to that of lower insulating resin layer 23A, and when a thickness of upper resistor resin layer 12 is equal to that of lower resistor resin layer 25, the portion of each insulating particle 11B protruding from the surface of insulating resin 12A is equal to that portion of each insulating particle 23B protruding from the surface of insulating resin 25A. Then, insulating particles 11B and 23B can equally make contact with surfaces of insulating resins 25A and 12A, respectively. The upper and lower insulating resin layers do not necessarily need to be equal to the upper and lower resistor layers in thickness.

When a passenger sits, upper resistor layer 12 makes contact with lower resistor layer 25. A resistance of the seat sensor vanes according to the variation of load until the passenger is seated completely. A vehicle electronic circuit coupled to conductive layer 24 detects the variation of resistance and determines whether the seat has a passenger and whether the weight of the passenger is not less than a predetermined value.

According to the present embodiment, conductive layer 24 is formed by printing a predetermined distance apart from lower insulating layer 23 over bottom sheet 3. Lower resistor layer 25 is formed over lower insulating layer 23 with direct contact as in upper resistor layer 12. Therefore, when a thickness of upper insulating resin layer 11A is equal to that of lower insulating resin layer 23A, and a thickness of upper resistor resin layer 12 is equal to that of lower resistor resin layer 25, the portion of each insulating particle 11B protruding from the surface of upper resistor layer 12 is equal to that portion of each insulating particle 23B protruding from the surface of lower resistor layer 25. The portion of each of the insulating particles 11B or 23B can be adjusted by varying the thickness of the upper and lower resistor layers 12 and 25, respectively. As a result, a seat sensor with smooth and stable resistance properties can be produced.

Figure 8A:
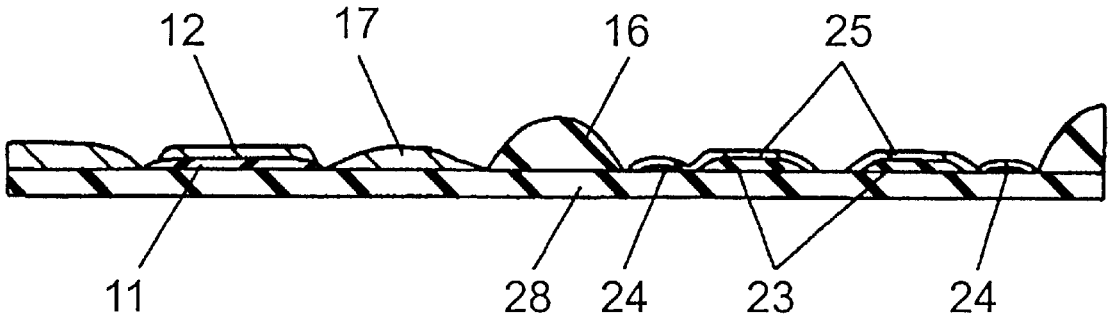
FIG. 8A is a cross sectional view of a seat sensor in which a top sheet is integrated with a bottom sheet in accordance with the second exemplary embodiment of the present invention.
Figure 8B:
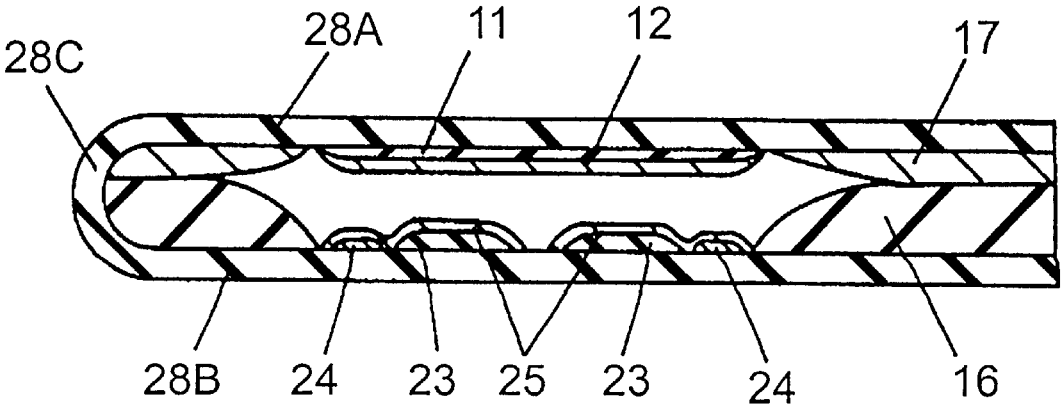
FIG. 8B is a cross sectional view of a seat sensor in which an integrated top sheet and bottom sheet are folded together.

Further, in a different structure shown in FIG. 8A, upper insulating layer 11, upper resistor layer 12 and adhesive layer 17 are formed on a left portion of sheet 28 and lower insulating layer 23, conductive layer 24, lower resistor layer 25 and insulating spacer layer 16 are formed on the right portion of sheet 28, respectively, by printing. Next, as shown in FIG. 8B, the sheet having top sheet 28A and bottom sheet 28B is bent at the center portion 28C so that upper resistor layer 12 underneath top sheet 28A is opposed to lower resistor layer 25 over bottom sheet 28B, then top sheet 28A is bonded to bottom sheet 28B by adhesive layer 17. According to the structure above, a more inexpensive seat sensor having fewer components can be produced.

In the description above, the seat sensor has insulating spacer layer 16 formed by printing over bottom sheets 3 and 28B, adhesive layer 17 formed by printing underneath top sheet 1 and 28A, respectively. On the contrary, a seat sensor having spacer layer 16 formed underneath top sheets 1 and 28A and having adhesive layer 17 formed over bottom sheets 3 and 28B may be produced. Further, an adhesive layer 17 may be formed over insulating spacer layer 16.

Third Embodiment

Figure 9:
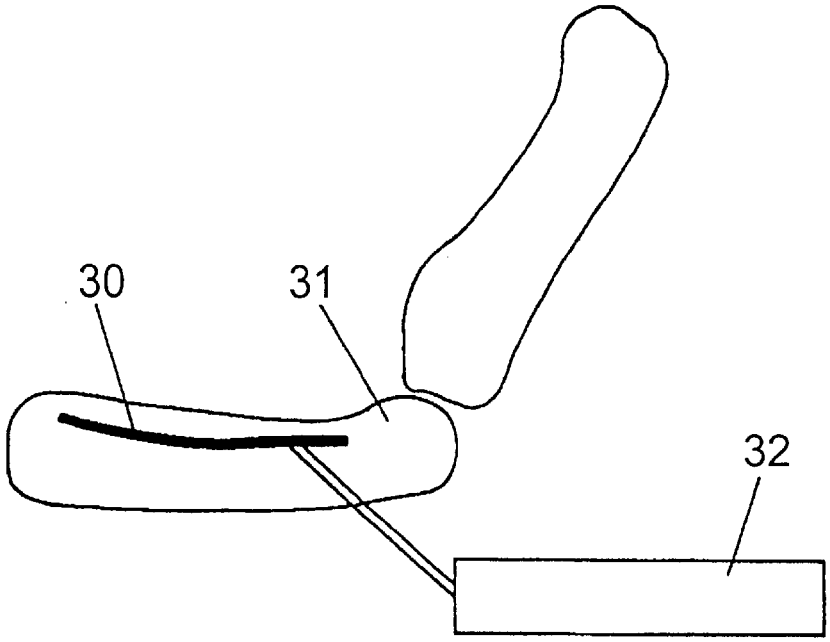
FIG. 9 is a block diagram of a detection device in accordance with a third exemplary embodiment of the present invention.
Figure 10:
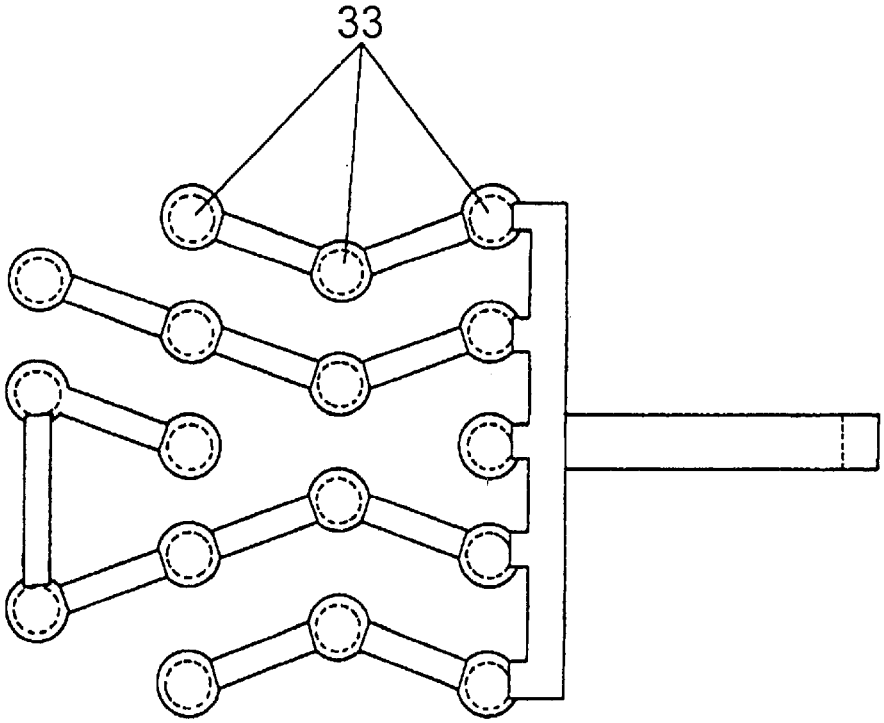
FIG. 10 is a plan view of the detection device with a plurality of contact points integrally linked to each other in accordance with the third exemplary embodiment of the present invention.
Figure 11:
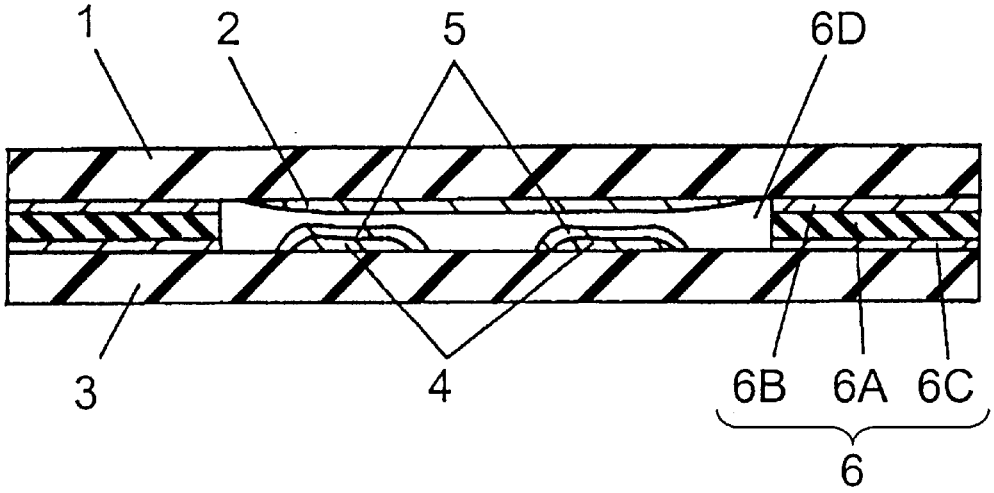
FIG. 11 PRIOR ART
FIG. 11 is a cross sectional view of a conventional seat sensor.
Figure 12:
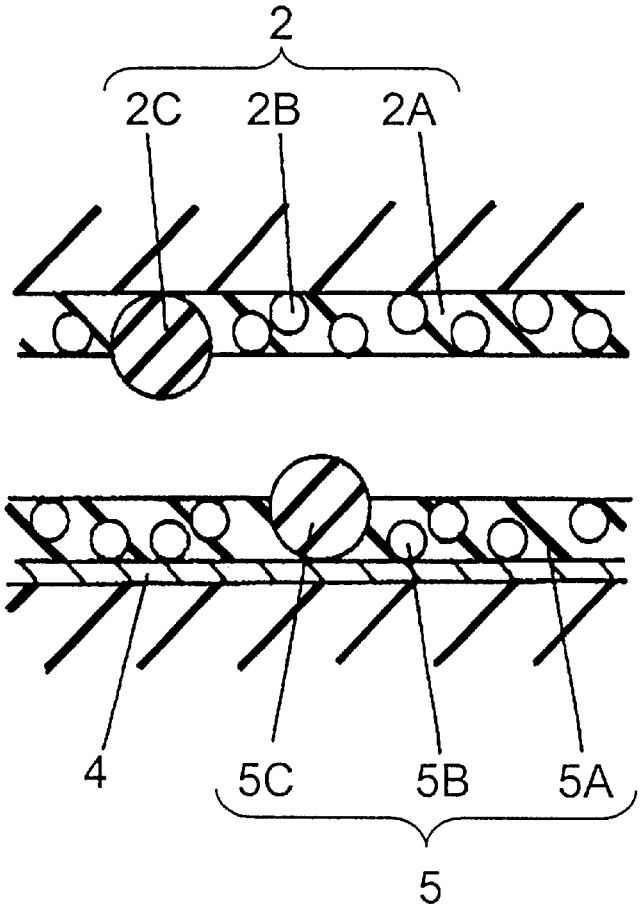
FIG. 12 PRIOR ART
FIG. 12 is an enlarged cross sectional view of the conventional seat sensor.
Figure 13:
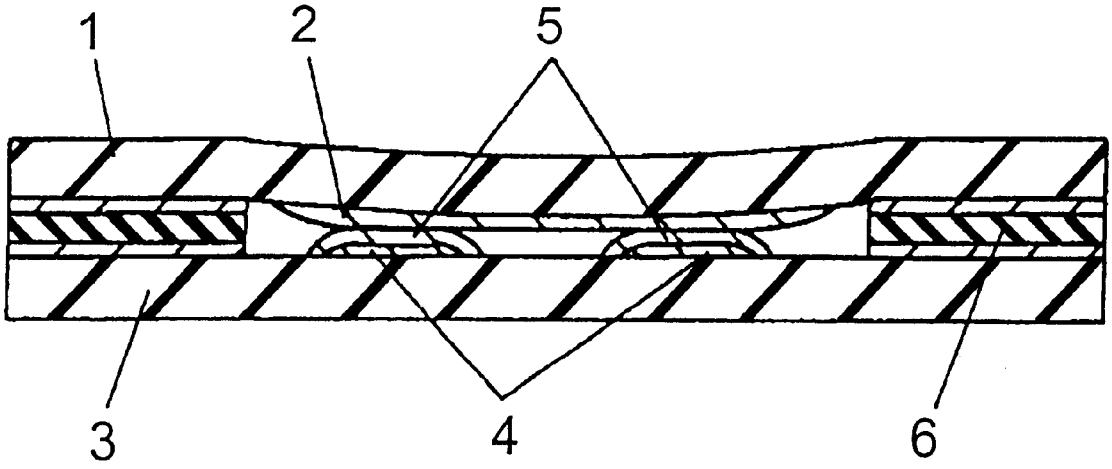
FIG. 13 PRIOR ART
FIG. 13 is a cross sectional view of the conventional seat sensor in operation.
Figure 14A:
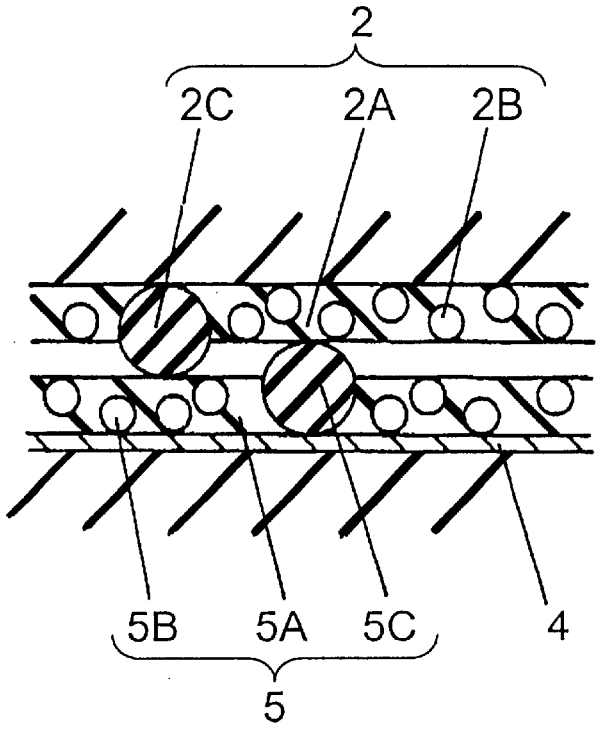
FIG. 14A PRIOR ART
FIG. 14A is an enlarged cross sectional view of the conventional seat sensor in operation in a first stage of contact.
Figure 14B:
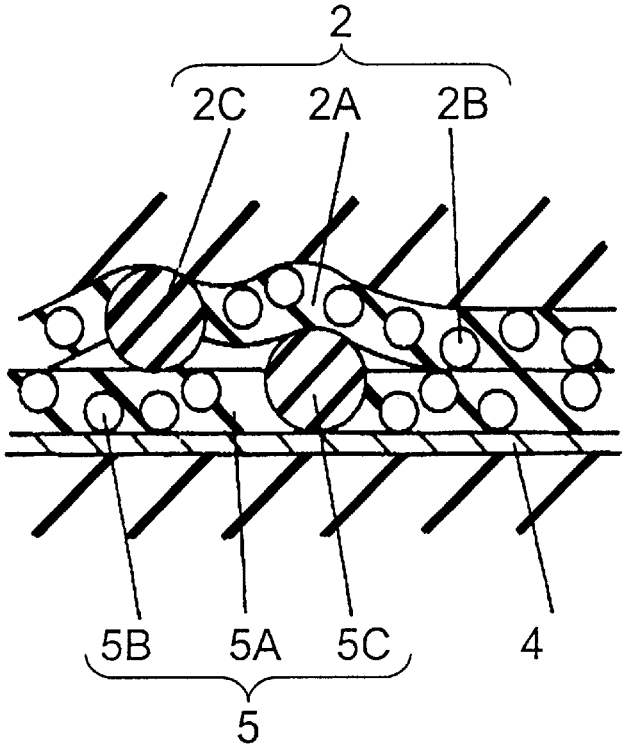
FIG. 14B PRIOR ART
FIG. 14B is an enlarged cross-sectional view of the conventional seat sensor in operation in a second stage of contact.
Figure 15:
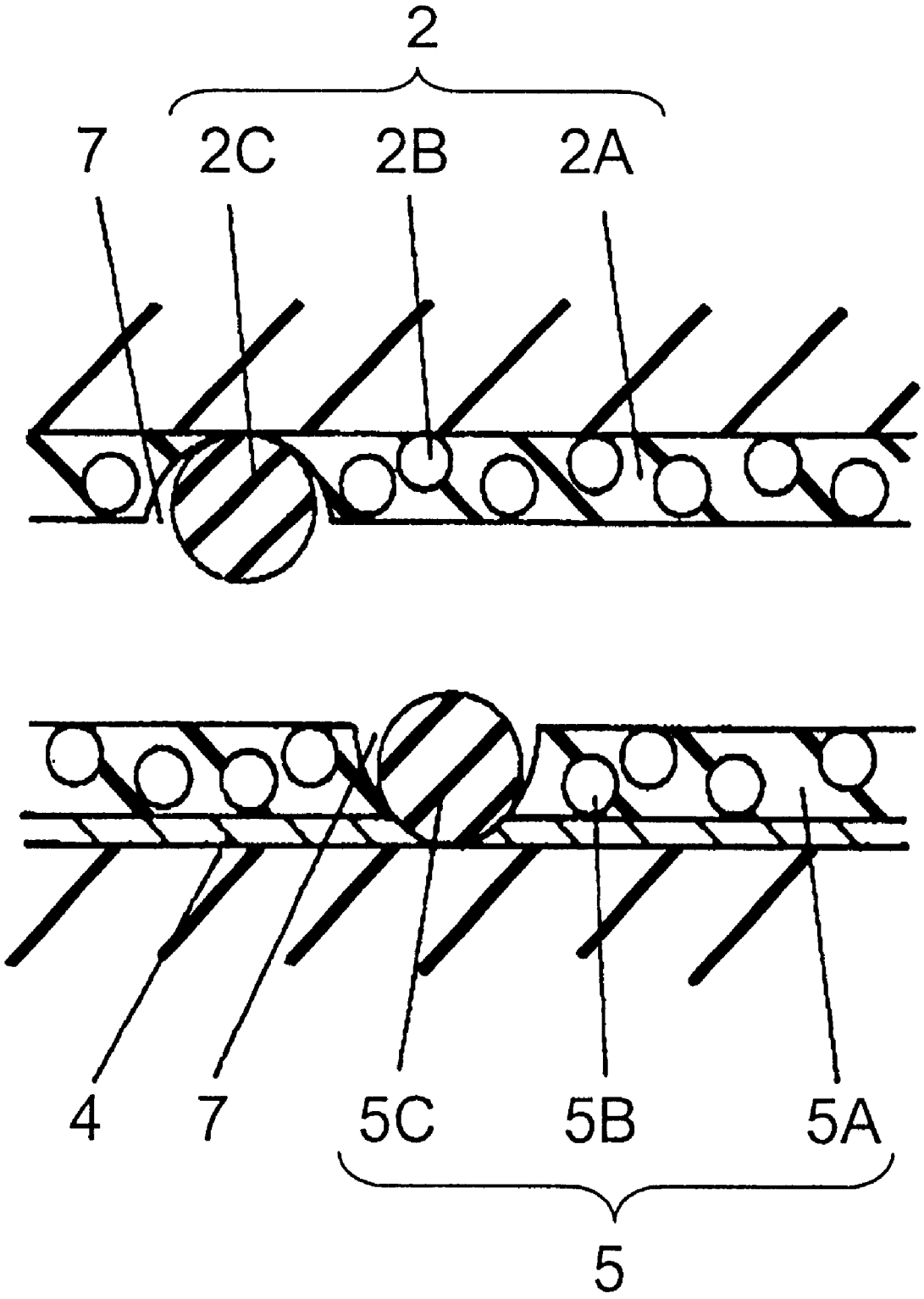
FIG. 15 PRIOR ART
FIG. 15 is an enlarged cross sectional view of the conventional seat sensor after repeated operation.

FIG. 9 is a block diagram of a detection device according to a third embodiment In FIG. 9, seat sensor 30 described in the first and second embodiments is placed in the backside of the seating position in the vehicle seat 31 and is coupled to detecting Circuit 32 to form a detection device.

When a passenger sits on the vehicle seat 31 and a load, such as a weight of the passenger, is applied on seat sensor 30, the resistance of seat sensor 30 varies as described in the first and second embodiments. When the passenger is seated completely and the load reaches a constant value, a resistance of seat sensor 30 also reaches to a constant value not more than a predetermined value, which detecting circuit 32 detects.

Detecting circuit 32 determines whether the load applied on seat sensor 30 is not less than a predetermined value depending on whether the resistance is not more than a predetermined value. In other words, detecting circuit 32 determines the existence of a passenger and the weight of the passenger based on a load applied on seat sensor 30. The detecting circuit outputs the detected data to a vehicle electronic circuit (not shown). After a confirmation of the existence of a passenger, a sign for wearing a seatbelt is indicated and actuation of an air-bag system is controlled by judging whether the weight of the passenger is not less than a predetermined value.

According to the present embodiment, thus, detecting circuit 32 with seat sensor 30 detects resistance at the time a load is applied on seat sensor 30, judges the load applied on seat sensor 30 according to a difference in the resistance of seat sensor 30, and makes various controls.

Namely, the detection device of the present invention has seat sensor 30 and detecting circuit 32. The detection device detects an existence of a passenger and determines the passenger's weight based on differences of each resistance detected by seat sensor 30. Furthermore, various functions, for example, actuation of an air-bag system or indication of a seat-belt sign, are controlled. The present invention can provide such a detection device inexpensively.

In the first and second embodiments, the seat sensor having upper resistor layer 12 and lower resistor layer 15 is described. However, for the bigger seat which requires several seat sensors, it takes time and labor to install all of the required seat sensors inside the seat and couple them to the detecting circuit one by one. Therefore, as shown in a plan view in FIG. 10, an inexpensive detection device is assembled easily by using a seat sensor with a plurality of contact portions 33 integrally linked by forming a plurality of upper resistor layers 12 and lower resistor layers 15 over the top sheet 1 and the bottom sheet 3.

According to the present invention described above, a seat sensor having stable resistance characteristics even after repeated loading, and a detection device using the seat sensor can be provided.

What is claimed is:

1. A seat sensor comprising:

a top sheet made of insulating film;

an upper insulating layer having insulating particles partially protruding therefrom, said upper insulating layer being formed underneath said top sheet;

an upper resistor layer formed underneath said upper insulating layer;

a bottom sheet made of insulating resin film and being arranged under said top sheet;

a lower insulating layer having insulating particles partially protruding therefrom, said lower insulating layer being formed over said bottom sheet;

a lower resistor layer formed over said lower insulating layer; and an insulating spacer layer between said top sheet and said bottom sheet.

2. The seat sensor as defined in claim 1, wherein said upper resistor layer and said lower resistor layer comprise resin and carbon-based conductive particles dispersed in said resin.

3. The seat sensor as defined in claim 1, further comprising a conductive layer formed at least one of between said upper insulating layer and said upper resistor layer, and between said lower insulating layer and said lower resistor layer.

4. The seat sensor as defined in claim 3, wherein said conductive layer comprises resin and silver-based conductive particles dispersed in said resin.

5. The seat sensor as defined in claim 1, wherein said insulating spacer layer has smoothly sloped ends.

6. The seat sensor as defined in claim 1, wherein said insulating spacer layer has ends, each of said ends having a cross sectional shape of at least one of a straight line, an arcuate line and a curve.

7. The seat sensor as defined in claim 1, further comprising a plurality of upper insulating layers, a plurality of lower insulating layers, a plurality of upper resistor layers, a plurality of lower resistor layers, a plurality of upper conductive layers, and a plurality of lower conductive layers formed over said top sheet and said bottom sheet, respectively.

8. A seat sensor comprising:

a top sheet made of insulating film;

an upper insulating layer having insulating particles partially protruding therefrom, said upper insulating layer being formed underneath said top sheet;

an upper resistor layer formed underneath said upper insulating layer;

a bottom sheet made of insulating resin film and being arranged under said top sheet;

a lower insulating layer having insulating particles partially protruding therefrom, said lower insulating layer being formed over said bottom sheet;

a lower resistor layer formed over said lower insulating layer;

an insulating spacer layer formed between said top sheet and said bottom sheet;

a second conductive layer formed at least one of underneath said top sheet and over said bottom sheet, said second conductive layer being a predetermined distance from said upper insulating layer and said lower insulating layer, wherein each of said upper resistor layer and said lower resistor layer continuously covers said second conductive layer and said upper insulating layer and said lower insulating layer, respectively.

9. The seat sensor as defined in claim 8, wherein said insulating spacer layer has smoothly sloped ends.

10. The seat sensor as defined in claim 8, wherein said insulating spacer layer has ends, each of said ends having a cross sectional shape of at least one of a straight line, an arcuate line and a curve.

11. The seat sensor as defined in claim 8, further comprising a plurality of upper insulating layers, a plurality of lower insulating layers, a plurality of upper resistor layers, a plurality of lower resistor layers, a plurality of upper conductive layers, and a plurality of lower conductive layers formed over said top sheet and said bottom sheet, respectively.

12. A seat sensor comprising:

a top sheet made of insulating film;

an upper insulating layer having insulating particles partially protruding therefrom, said upper insulating layer being formed underneath said top sheet;

an upper resistor layer formed underneath said upper insulating layer;

a bottom sheet made of insulating resin films and being arranged under said top sheet;

a lower insulating layer having insulating particles partially protruding therefrom, said lower insulating layer being formed over said bottom sheet;

a lower resistor layer formed over said lower insulating layer; and an insulating spacer layer formed between said top sheet and said bottom sheet, wherein said top sheet and said bottom sheet are formed integrally and are bent so that said upper resistor layer and said lower resistor layer oppose each other.

13. The seat sensor as defined in claim 12, wherein said insulating spacer layer has smoothly sloped ends.

14. The seat sensor as defined in claim 12, wherein said insulating spacer layer has ends, each of said ends having a cross sectional shape of at least one of a straight line, an arcuate line and a curve.

15. The seat sensor as defined in claim 12, further comprising a plurality of upper insulating layers, a plurality of lower insulating layers, a plurality of upper resistor layers, a plurality of lower resistor layers, a plurality of upper conductive layers, and a plurality of lower conductive layers formed over said integrally formed top sheet and said bottom sheet.

16. A detection device comprising:

(A) a seat sensor comprising:

a top sheet made of insulating films;

an upper insulating layer having insulating particles partially protruding therefrom, said upper resistor layer being formed underneath said top sheet;

an upper resistor layer formed underneath said upper insulating layer;

a bottom sheet made of insulating resin film and being arranged under said top sheet;

a lower insulating layer having insulating particles partially protruding therefrom, said lower insulating layer being formed over said bottom sheet; and a lower resistor layer formed over said lower insulating layer; and (B) a detecting circuit, wherein said detecting circuit detects a resistance of said seat sensor, judges a load applied on the seat sensor according to differences of detected resistance, and controls various functions according to the load.

17. The detection device as defined in claim 16, further further comprising:

a second conductive layer formed at least one of underneath said top sheet and over said bottom sheet, said second conductive layer being a predetermined distance from said upper insulating layer and said lower insulating layer, wherein each of said upper resistor layer and said lower resistor layer continuously cover said second conductive layer and said upper insulating layer and said lower insulating layer, respectively.

18. The detection device as defined in claim 16, wherein said top sheet and said bottom sheet are formed integrally and are bent so that said upper resistor layer and said lower resistor layer oppose each other.

* * * * *